US009291417B2

(12) United States Patent
James

(10) Patent No.: US 9,291,417 B2
(45) Date of Patent: Mar. 22, 2016

(54) NOISE SUPPRESSOR FOR FIREARMS

(71) Applicant: Jesse Gregory James, Austin, TX (US)

(72) Inventor: Jesse Gregory James, Austin, TX (US)

( * ) Notice: Subject to any disclaimer, the term of this patent is extended or adjusted under 35 U.S.C. 154(b) by 0 days.

(21) Appl. No.: 14/559,910

(22) Filed: Dec. 3, 2014

(65) Prior Publication Data

US 2015/0308772 A1 Oct. 29, 2015

Related U.S. Application Data

(60) Provisional application No. 61/985,832, filed on Apr. 29, 2014, provisional application No. 61/911,782, filed on Dec. 4, 2013.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/34
USPC ..... 89/14.2–14.4; 181/223
See application file for complete search history.

(56) References Cited

U.S. PATENT DOCUMENTS 2,514,996 A * 7/1950 Faust, Jr. ..... F41A 21/30 181/223
4,576,083 A * 3/1986 Seberger, Jr. ..... F01N 1/08 181/223

* cited by examiner

*Primary Examiner* — Reginald Tillman, Jr.
(74) *Attorney, Agent, or Firm* — Matthew E. Burr

(57) ABSTRACT

A suppressor to diminish the volume of noise from firing a firearm provides a suppressor body shape with tapered ends. The shape of the suppressor forms a partial wave-form to accommodate the wave-forms of the ignition gasses as they expand inside the chamber. Providing a chamber with a partial wave-form shaped interior space facilitates rapid dissipation of the expansion energy of the ignition gasses to quickly quell noise produced by such expansion. Perforated baffles housed in the interior chamber of the suppressor disrupt the fluid flow as the ignition gasses proceed through the chamber, which further dissipates the energy of the gasses. A fluid discharge port evacuates fluid from the primary chamber of the suppressor.

6 Claims, 8 Drawing Sheets

NOISE SUPPRESSOR FOR FIREARMS

CROSS-REFERENCE TO RELATED APPLICATIONS

The present application is related to, claims the benefit of and priority from U.S. provisional application Ser. No. 61/911,782 of the same title and by the same inventor, filed Dec. 4, 2013; and U.S. provisional application Ser. No. 61/985,832 also of the same title and by the same inventor, filed Apr. 29, 2014, the disclosures of which provisional applications is incorporated herein by reference as if set forth in full.

TECHNICAL FIELD

The present invention deals generally with firearm accessories and, more particularly, with noise and flash suppressors for firearm muzzles.

BACKGROUND

The terms used below, such as front and back, or front and rear, relate to the firing direction, with the front pointing in the firing direction, the back pointing away from the firing direction. Where proximal or distal are used to explain a feature, proximal will refer to herein as the back and the distal will refer to herein as the front.

To set the stage for developing improved suppressors, it is necessary first to identify the critical elements of the attendant flow fields as thoroughly documented in Klingenberg, Firearmter and Heimerl, Joseph M., Firearm Muzzle Blast and Flash, AIAA Progress in Astronautics and Aeronautics, Volume 139, 1992.

These characteristics can be broken down into three core elements. The first two core elements are: the precursor blast; and a main blast set up by the expanding gases. The precursor blast consists of mostly air with a small amount of propellant and the main blast is made up of spherical pressure waves that quickly overtake the fired projectile. Both of these blasts are sources of low frequency noise that carry very far distances. The third core element is the highly visible gas flash which follows the blast.

In general, a gas flash occurs because air mixes with the fuel rich propellants and the high temperatures from the blast waves. The result of this mixture forms a gas flash which is greatly increased in the secondary flow region that occurs away from the muzzle of a firearm.

When a gas flash forms, it occurs in three parts: primary, intermediate, and secondary flashes. The primary flash forms at the muzzle in the supersonic flow region and is very small. An intermediate flash occurs directly behind the projectile, but in front of the Mach disk leading any supersonic flow region. (Not all firearms have supersonic discharge flows.) The secondary flash is the most severe, and it occurs downstream of the firearm muzzle, and after the normal shock resulting from the muzzle gas over-expansion. The large flash seen when firing a projectile is actually the secondary flash.

With an understanding of the three core elements involved in the blast and flash from a projectile, the individual components can be analyzed to assess their critical components.

Traditionally, suppressors (also referred to as silencers) have been built with an outer tube and internal baffling components. The outer tube is steel or aluminum tubing and has end caps, either welded or threaded in place. The internal components are typically a set of flat disks each having a hole through the center thereof with spacers therebetween to create a volume of space (referred to as a baffle chamber) between each set of disks. Improvements on the flat spacer configuration include various expansion cone shape baffles that are either machined or stamped. Some of these baffles include holes at various places to re-direct gases and increase turbulence of the gases internally as the bullet passes thought the baffles. Such a configuration aids in reducing the noise produced by the firearm.

The pieces of the outer tube attach in a gas-tight manner onto, for example, an outside thread on the muzzle of a rifle. The disks extend in a plane that is orthogonal to the firing axis of the barrel. The firing opening of the disks can taper outward towards the front.

More modern suppressors that make use of what are referred to as "M" and "K" baffles incorporate both the expansion cone concept with the spacer as a single unit. These units are individually machined on a Computer Numerical Control (CNC) lathe and stacked on top of one another and are subject to stack-up tolerances during assembly. Recent designs include a monolithic baffle that is either drilled or milled from a round piece of stock. For example, U.S. Pat. Nos. 6,079,311 and 6,302,009 to O'Quinn et al. describe a monolithic baffle drilled or milled from a round piece of stock.

Characteristics of designing a suppressor include the number and the shape of the chamber parts. Each silencer also must be adapted to the weapon and to the ammunition used in the weapon. Another aspect to consider in this context is the silencer's sound-reducing requirements. Each chamber part reduces the muzzle report by a given amount and, therefore, a larger number of chambers is desirable. However, because the silencer increases the total length of the firearm and adds weight to the muzzle (thus impairing the weapon's balance), overall, the silencer should be as short and light as possible.

Considering the principal characteristics of the blast wave, studies have found that it is essentially a spherical blast wave that travels rapidly but also decays rapidly both strength-wise and time/distance-wise. Relative to the flow-field attendant to the flash, it establishes after or behind the main blast wave with a structure very similar to that of a traditional under-expanded jet plume often seen in propulsion applications. The key elements of the post-blast wave flow field are the free jet boundary and the highly under-expanded jet flow region all flowing strongly in the downstream axial direction. The over-expanded gas results in the normal shock or Mach disk, which causes the secondary flash and a significant portion of the noise. The important point is that the key physics of this type of flow structure is common in propulsion aerodynamics, and can be used to generate performance correlations for use in developing more efficient suppressor designs.

There are a wide range of firearm suppressor designs. All current designs apparently have three recurrent features: 1.) a circular or near circular cross-section with a diameter approximately five times the firearm's muzzle diameter; 2.) a solid outer surface so no gases can enter or escape the suppressor except through its entrance and exit ports; and 3.) complex flow nozzles, baffles and/or chambers interior to the suppressor for capturing the muzzle gases and mitigating the blast over-pressure level.

U.S. Pat. No. 2,363,563 relates to an air-cooled gun barrel and discloses a cooling device that is applied to the end of a usual jacket cylinder of a barrel of an automatic (rapid) firing weapon. The cooling device comprises a short sleeve in the interior of which three ring members are arranged and secured to the inside surface of the sleeve by radial fins. The three rings are specifically arranged in the annular space between sleeve and the central bullet passage way. These rings are—in the longitudinal direction—first diverging and thereafter converging.

The ring members acting as aspirating rings confine the expansion of an expanding flame sheet issued from the barrel muzzle and create suction at and beyond the gun muzzle which causes a flow of air along the barrel, the air entering the annular space between the barrel and the jacket through airports.

Thus, the device disclosed in U.S. Pat. No. 2,363,563 is provided to cause airflow within the annular space between the gun barrel and the jacket cylinder so as to cool the gun barrel of an automatic rapid firing weapon.

U.S. Pat. No. 1,860,276 is concerned with a firearm and discloses a firearm suppressor comprising a sleeve that is fixed on the outside of the gun in any convenient manner as for instance by screwing.

Accordingly, it is a primary objective of the present invention to provide a firearm suppressor that employs advanced fluid dynamic principles to consistently deliver levels of noise and flash suppression equal to or better than current suppressors.

It is another primary objective to provide an improved firearm suppressor with significantly increased useful life span over that of current firearm suppressors.

It is another primary objective to provide an improved firearm suppressor technology to control the muzzle blast wave and overexpansion flow for better suppression.

It is another objective, commensurate with the above-listed objects, to provide an improved suppressor which is durable and safe to use.

A further objective is to provide a firearms suppressor having means to evacuate the suppressor chamber of fluids such as water for use after immersion in a fluid.

SUMMARY

A suppressor to diminish the volume of noise from firing a firearm provides a suppressor body shape with tapered ends. The shape of the suppressor forms a partial wave-form to accommodate the wave-forms of the ignition gasses as they expand inside the chamber. Providing a chamber with a partial wave-form shaped interior space facilitates rapid dissipation of the expansion energy of the ignition gasses to quickly quell noise produced by such expansion. Perforated baffles housed in the interior chamber of the suppressor disrupt the fluid flow as the ignition gasses proceed through the chamber, which further dissipates the energy of the gasses. A fluid discharge port evacuates fluid from the primary chamber of the suppressor.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

Figure 1:
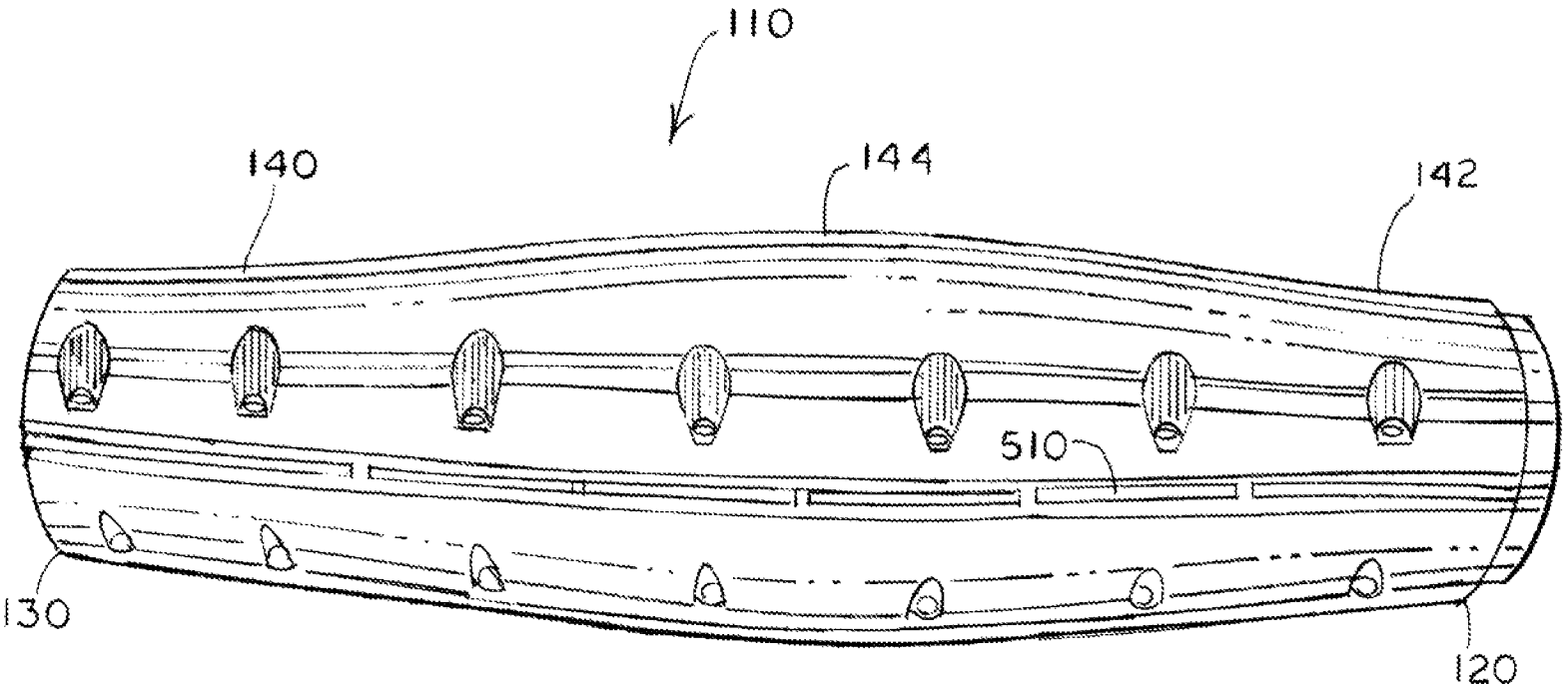
FIG. 1 is a diagrammatic illustration of an exterior side view of a suppressor of the present disclosure.

The present suppressor fastens at the proximal end to the terminus of the barrel of a firearm. Baffles mounted in the interior of the suppressor FIG. 1 is a diagrammatic illustration of an exterior side view of a suppressor 110 of the present disclosure. The present suppressor 110 fastens at the proximal end 120 to the terminus of the barrel of a firearm to suppress the volume of noise caused by firing the firearm. Noise is caused by the rapid expansion of gasses produced by igniting the incendiary substance of a bullet.

Suppressor 110 has distal portion 140 near distal end 130, proximal portion 142 near proximal end 120, and middle portion 144 between distal portion 140 and proximal portion 142. Proximal portion 142 and distal portion 140 are tapered relative to middle portion 144. That is, distal and proximal portion 140, 142, respectively, have a diameter less than the diameter of middle portion 144, and this change in diameter is obtained by smooth, continuous changes in diameter to achieve a tapered form.

Suppressor 110 provides an interior chamber with space for the ignition gasses to expand while at the same time partially containing the gasses so the gasses are ejected from the muzzle of the suppressor at its distal end. The suppressor 110 body shape with wide middle portion 144 and tapered ends 140, 142, and forms a partial wave-form to accommodate the wave-forms of the ignition gasses as they expand inside the chamber. Providing a chamber with a partial wave-form-shaped interior space facilitates rapid dissipation of the expansion energy of the ignition gasses to quickly quell noise produced by such expansion.

Figure 2A:
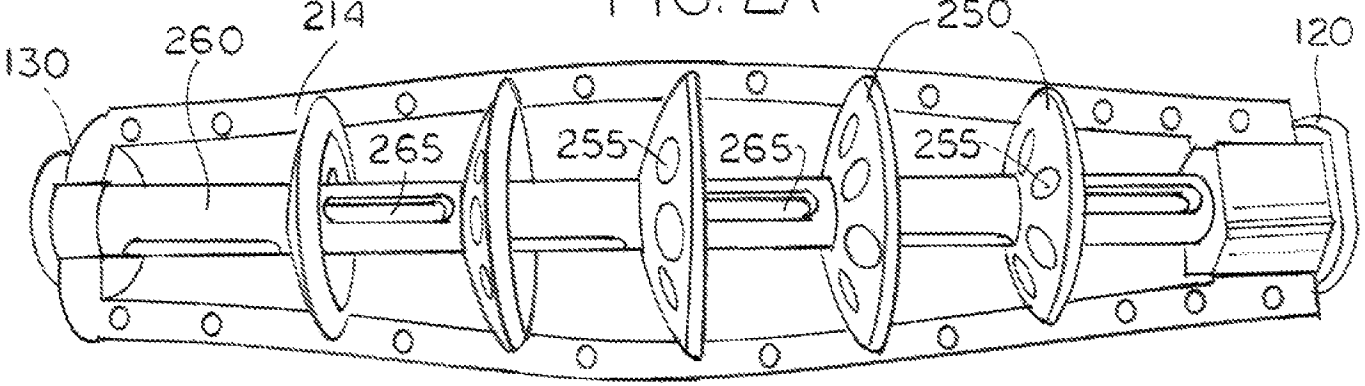
FIG. 2A is a diagrammatic illustration of an interior longitudinal cut-away side view of a suppressor of the present disclosure.
Figure 2B:
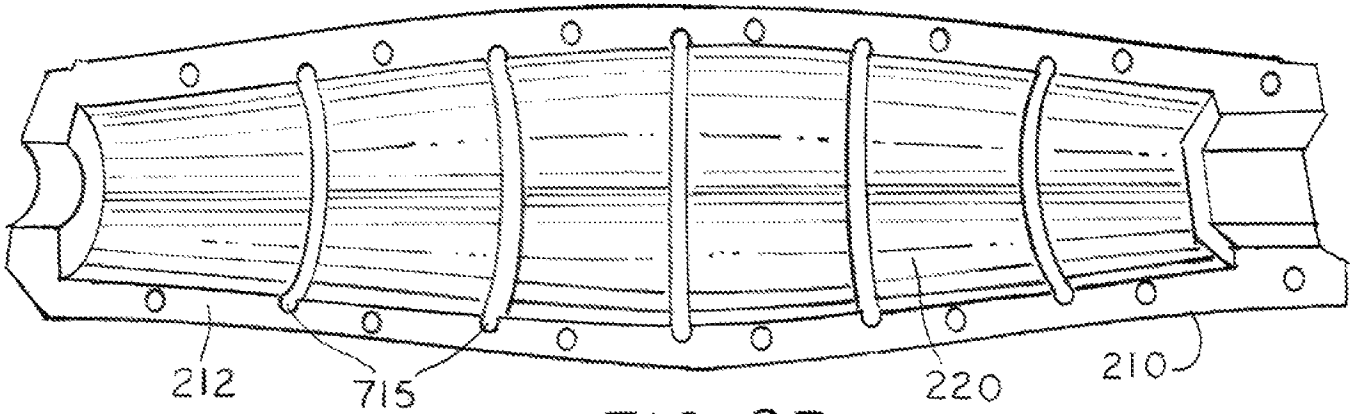
FIG. 2B is a diagrammatic illustration of an interior longitudinal cross-section side view of a suppressor housing of the present disclosure.

FIG. 2A is a diagrammatic illustration of an interior longitudinal cut-away side view of a suppressor of the present disclosure. FIG. 2B is a diagrammatic illustration of an interior longitudinal cross-section side view of a suppressor housing of the present disclosure.

FIGS. 2A and 2B are described together. Suppressor 110 provides housing 210 which is the exterior shell of interior chamber 220. Housing 210 is formed by two cooperatively fitting moieties 212 and 214. Suppressor barrel 260 traverses the length of interior chamber 210 of suppressor 110. Barrel vents 265 perforate barrel 260 and are spaced out along barrel 260 between baffles 250. In specific exemplary embodiments, vents 265 have an elongated shape that extends substantially along the distance between baffles 250.

A plurality of perforated baffles 250 of varying diameter are spaced out along the exterior of barrel 260. The plurality of baffles housed in interior chamber 220 further facilitates rapid dissipation of the gas expansion energy. The baffles have, preferably, a plurality of perforations 255 to allow gaseous fluid flow for the gasses to be ejected from the distal terminus 130 of suppressor 110. The perforated baffles 255 also disrupt the fluid flow as the ignition gasses proceeds through chamber 220, which further dissipates the energy of the gasses.

The interior surface of housing 210 moieties 212, 214, provide a plurality of grooves 715 that correspond to and receive baffles 250 to secure them in place.

Figure 3:
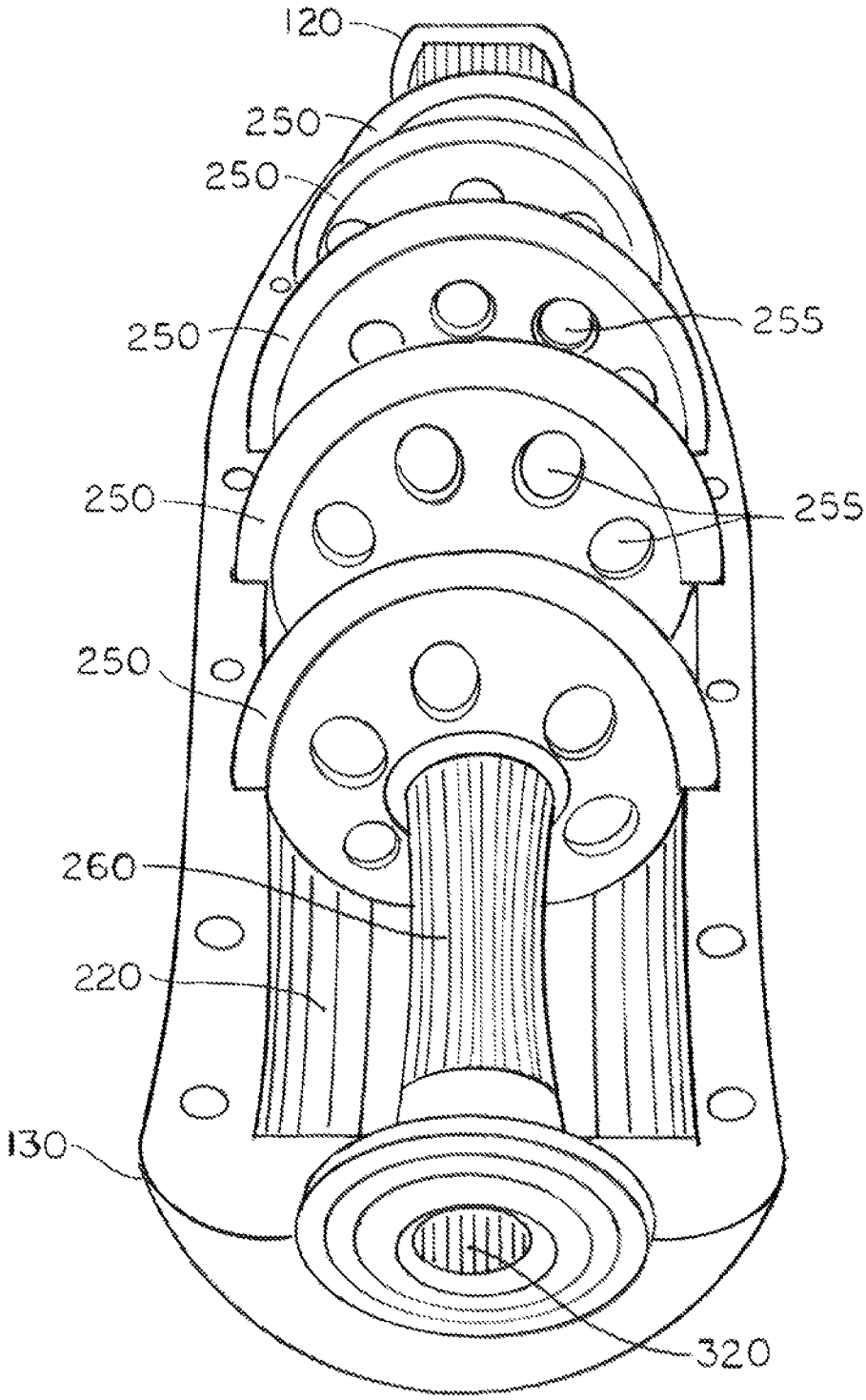
FIG. 3 is a diagrammatic illustration of an interior cut-away view of the distal end of a suppressor of the present disclosure.

FIG. 3 is a diagrammatic illustration of an interior cutaway view of the distal end of a suppressor of the present disclosure. Barrel 260 aligns with the barrel of the firearm to which suppressor 110 is selectively attachable. A bullet exits barrel 260 through the muzzle at barrel terminus 320. Each individual baffle 250 of the plurality of baffles is sized to have a suitable diameter to conform to the tapered shape of housing 210, such that baffles 250 in middle portion 144 have a greater diameter than the baffles 250 in proximal and distal portions 140, 142, respectively.

Figure 4:
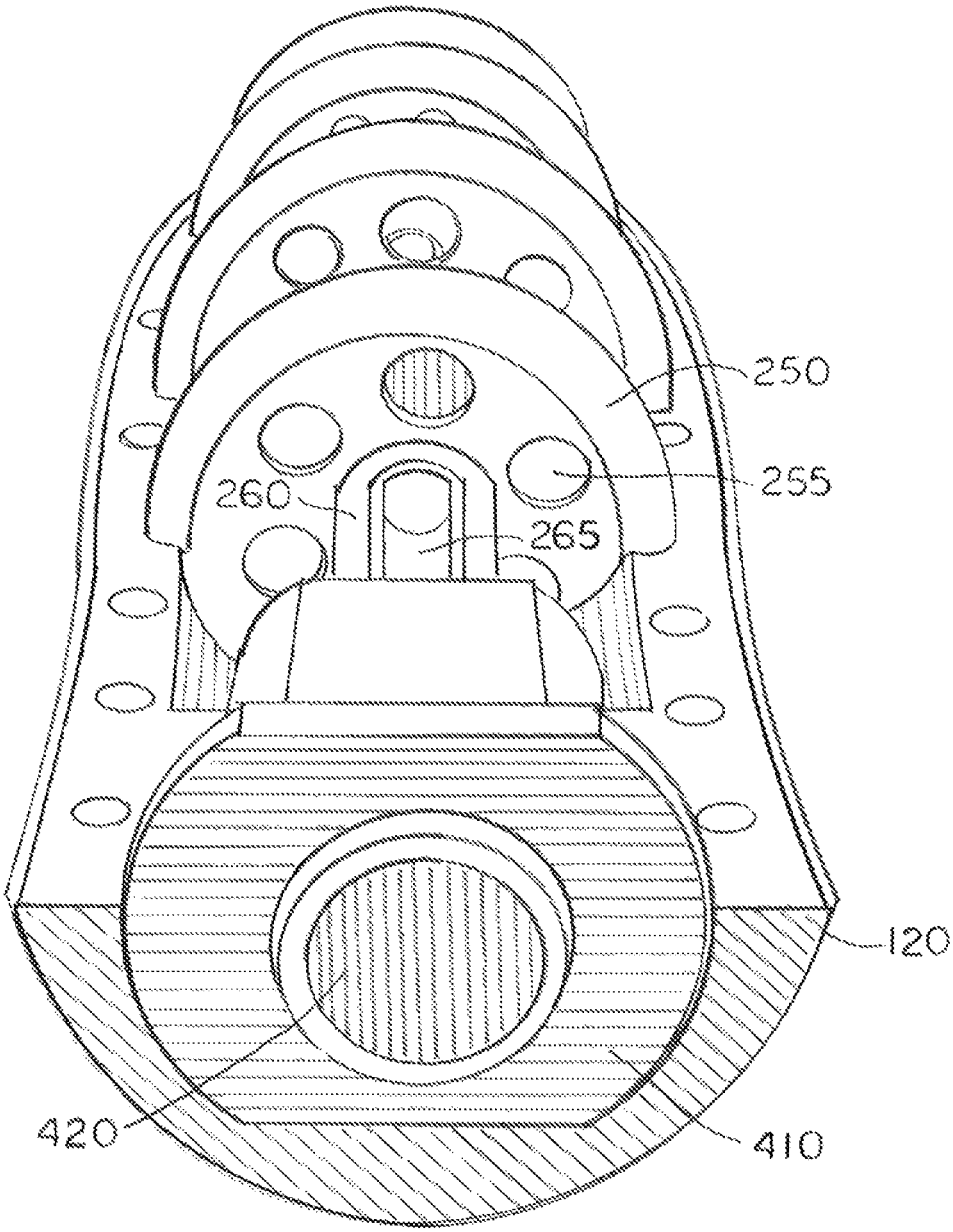
FIG. 4 is a diagrammatic illustration of an interior cut-away view of the proximal end of a suppressor of the present disclosure.

FIG. 4 is a diagrammatic illustration of an interior cutaway view of the proximal end of a suppressor of the present disclosure. Suppressor 110 is selectively attachable to the distal end of a firearm barrel with mount 410. Passageway 420 traverses through mount 410 and connects to suppressor barrel 260 to provide a continuous passageway for a bullet.

Figure 5:
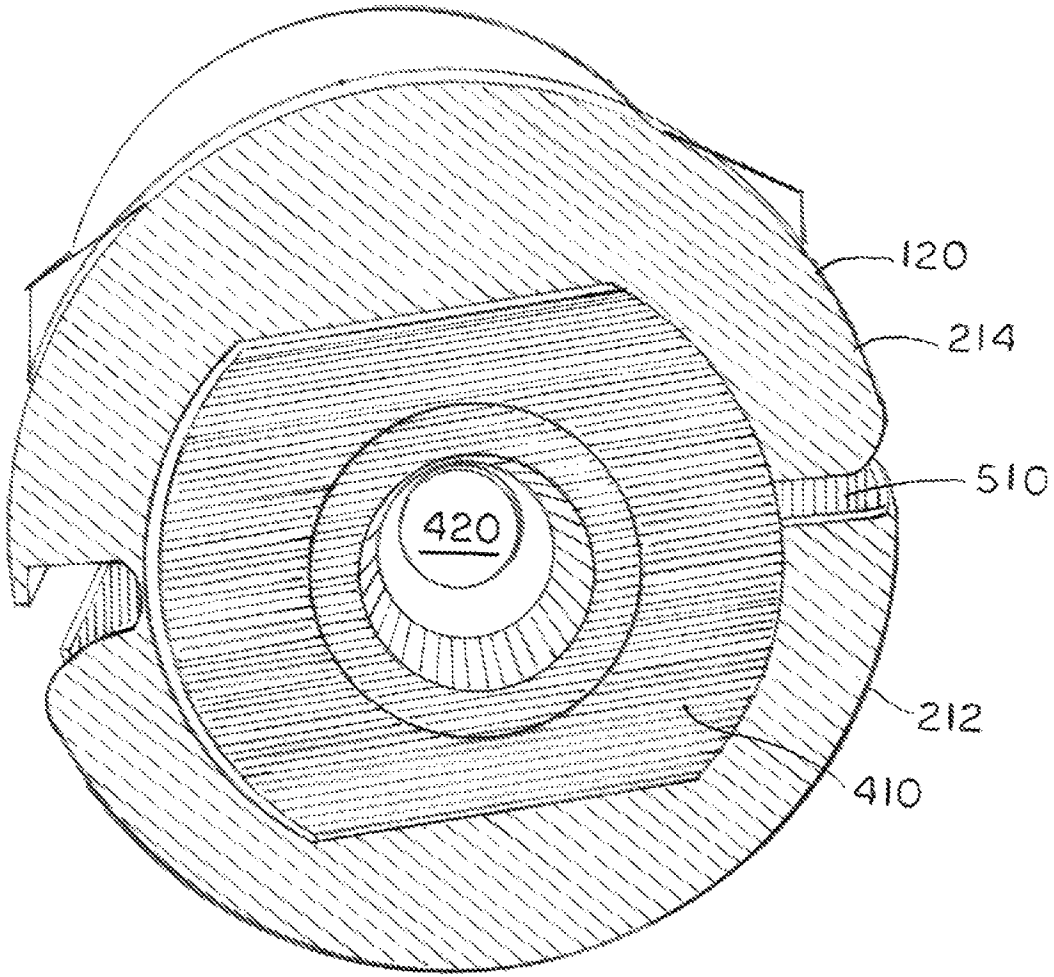
FIG. 5 is a diagrammatic illustration of an exterior front view of the proximal end of a suppressor of the present disclosure.

FIG. 5 is a diagrammatic illustration of an exterior front view of the proximal end of a suppressor of the present disclosure. Housing 210 moieties 212, 214 fit together to form seam 510.

Figure 6:
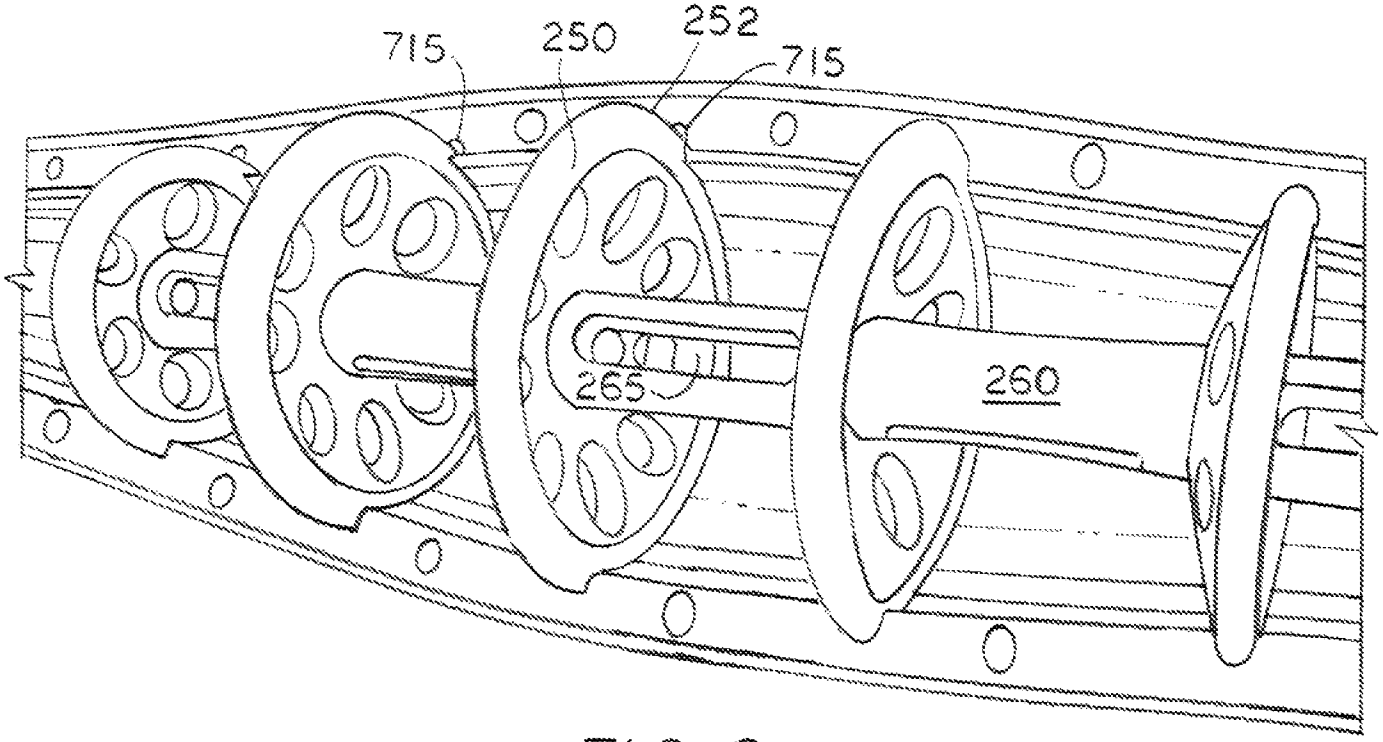
FIG. 6 is a diagrammatic illustration of an interior cut-away detail view of a suppressor of the present disclosure.

FIG. 6 is a diagrammatic illustration of an interior cutaway detail view of a suppressor of the present disclosure. The outer edge 252 of each individual baffle 250 of the plurality of baffles fits into a corresponding groove 715 formed on the interior surface of chamber 220 for secure positioning of each individual baffle 250. In specific exemplary embodiments, each individual baffle 250 has a concave shape.

Figure 7A:
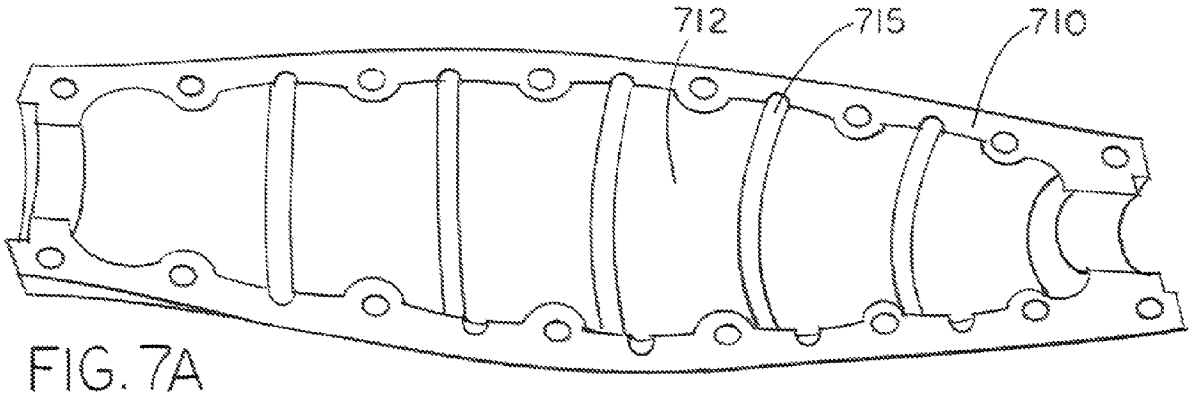
FIG. 7A is a diagrammatic illustration of an interior longitudinal cut-away view of an alternative embodiment of a suppressor of the present disclosure.
Figure 7B:
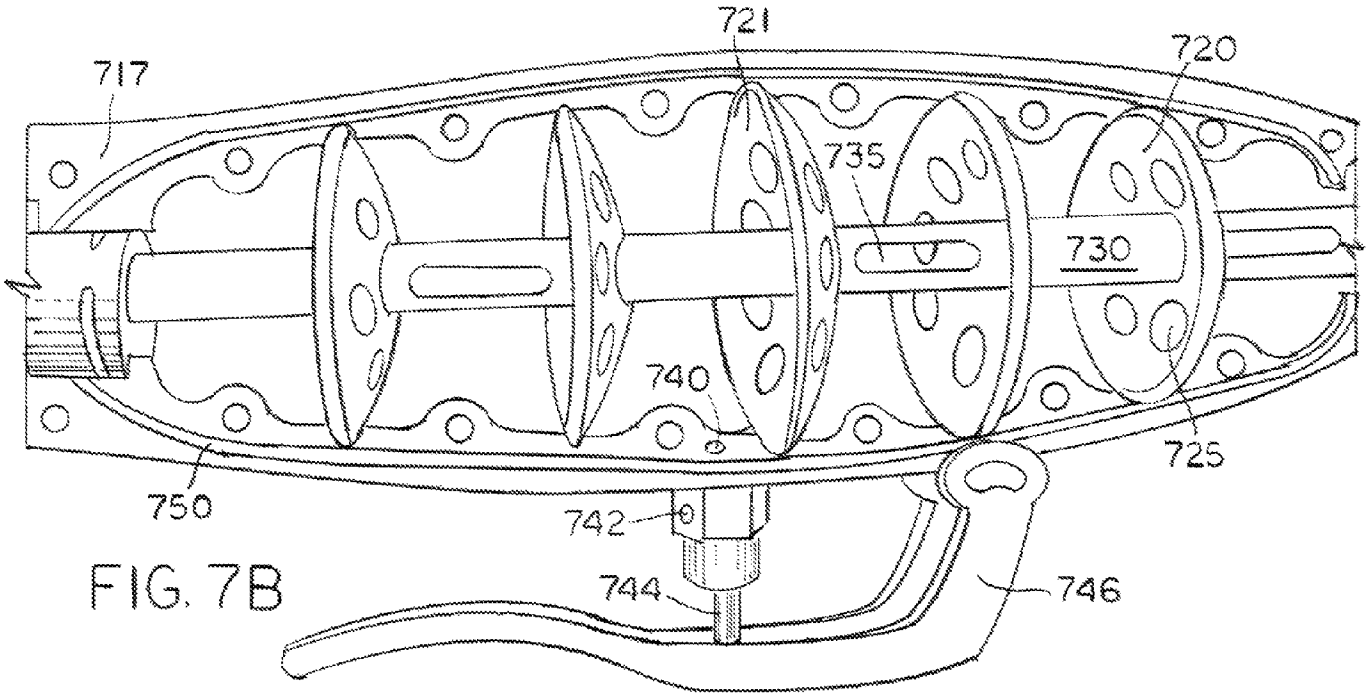
FIG. 7B is a diagrammatic illustration of an interior longitudinal cross-section view of an alternative embodiment of a suppressor housing of the present disclosure.

FIG. 7A is a diagrammatic illustration of an interior longitudinal cut-away view of an alternative embodiment of a suppressor of the present disclosure. FIG. 7B is a diagrammatic illustration of an interior longitudinal cross-section view of an alternative embodiment of a suppressor housing of the present disclosure. FIGS. 7A and 7B are described together, below.

Top moiety 710 reveals in cross-section primary chamber 712 and grooves 715 to receive baffles 720. Bottom moiety 717 in cross-section reveals a plurality of baffles 720 of varying diameter with the largest diameter 721 positioned substantially at the longitudinal center and the other of the plurality of baffles to both sides of center baffle 721 having smaller diameters. The space between each of the plurality of baffles defines a subchamber of the suppressor interior to provide a series of subchambers along the length of the suppressor. Each one of the plurality of baffles 720 has a plurality of perforations 725 to vent firing discharge gases from one of the plurality of subchambers to a neighboring subchamber.

Firing barrel 730 provides a bore (not shown) through which a projectile travels after firing the firearm. The barrel is adapted for noise suppression with a plurality of gas vent perforations 735 such that each bore perforation vents gases into a subchamber. The vents are oriented along the bore such that each vent is directed 90 degrees from the vent in the neighboring subchamber in an alternating fashion. The alternating orientation of the bore vents creates zones of relatively low pressure within each subchamber, thereby facilitating the expansion of discharge gases from one subchamber to another through baffle perforations 725. Moiety 717 further provides gasket 750 at least partially disposed within a receiving groove that extends around the perimeter of the primary suppressor chamber. Gasket 750 provides a seal around the primary chamber when top moiety 710 is fastened or joined to bottom moiety 717.

A further advantageous feature of the present suppressor is valve-operated fluid discharge port 740. Fluid discharge is useful after a firearm that has a suppressor of the present disclosure mounted on it has been submerged in water, for example. Accordingly, fluid discharge port 740 finds particular utility in military environments, but is also useful for water fowl hunters, as examples.

Port 740 provides a bore (not shown) that transits the suppressor wall from interior to exterior, terminating on the exterior of the suppressor wall at outlet 742. A valve disposed within outlet 742 is opened with pin 744, which is selectively actuated by lever 746.

Figure 8:
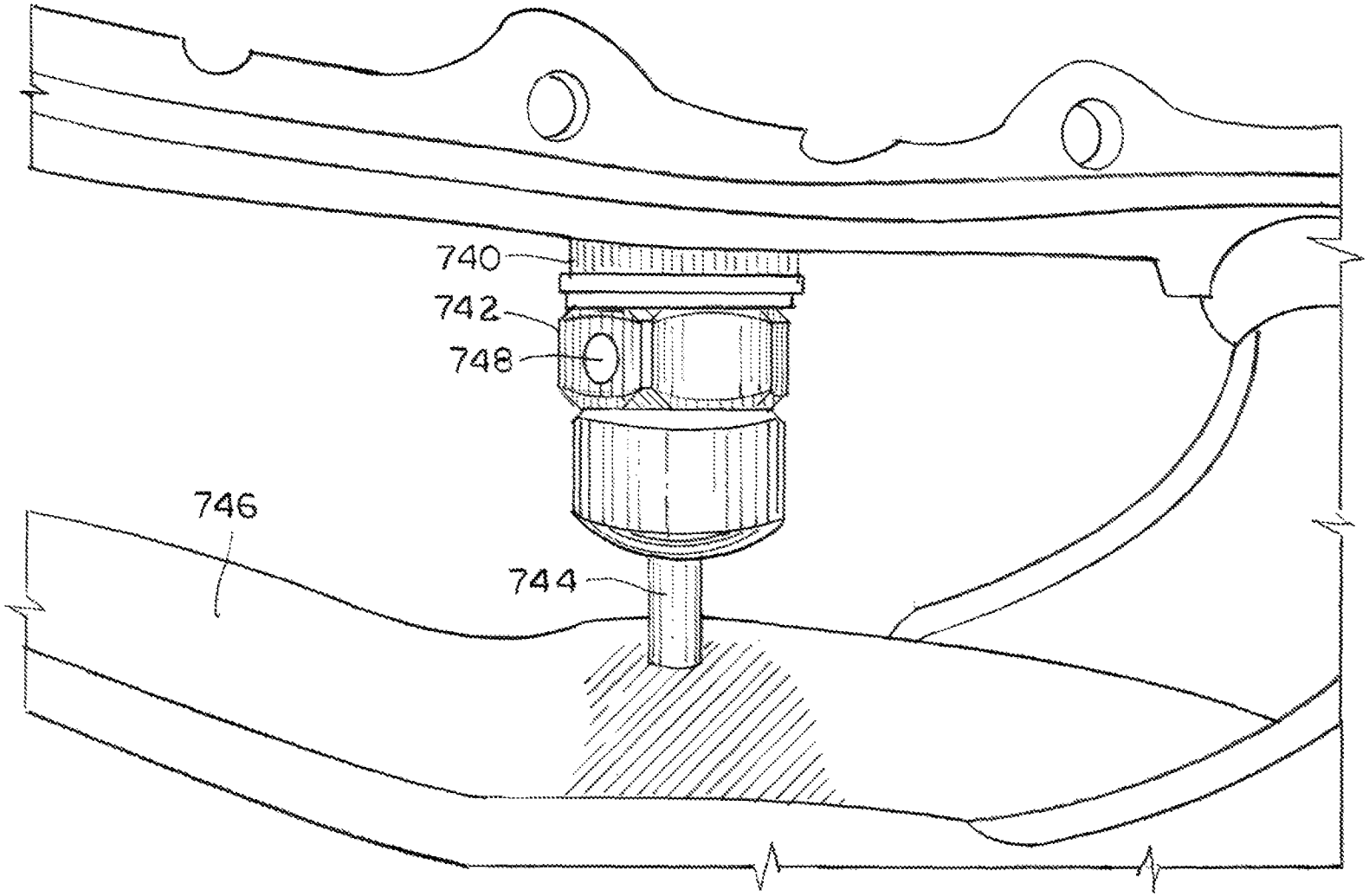
FIG. 8 is a diagrammatic illustration of a detail of the alternative embodiment of FIG. 7A.

FIG. 8 is a diagrammatic illustration of a detail of the alternative embodiment of FIG. 7A. FIG. 8 provides a detailed view of discharge port 740, and in particular outlet bore 748 evacuates fluid from outlet 742 when the discharge valve is open.

The shape of the present firearms noise suppressor advantageously exploits fluid flow dynamics to accommodate the shape of the pressure waves of the expanding ignition gasses from the discharge of a projectile to rapidly dissipate the pressure waves, reducing the volume of the noise produced by discharging a firearm. The use of a suppressor of the present disclosure provides many advantages over the prior art including enhanced gas expansion modes for noise suppression and fluid discharge means to evacuate water or other fluid.

Many modifications and other embodiments of the suppressor described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A firearms noise suppressor for firearms that have a barrel with a distal end wherein the noise suppressor is attachable to the distal end of the barrel, the noise suppressor comprising:

a housing having an exterior surface and an interior surface, an interior chamber defined by the interior surface of the housing, a proximate end that is attachable to the distal end of a firearm barrel, and a distal end, the housing being tapered at each of the distal and proximate ends;

a barrel disposed within the interior chamber and having an exterior surface, and further having a length extending from the proximate end to the distal end of the housing, the barrel further having a plurality of perforations spaced apart along the length to vent exhaust gases, the perforations being oriented so that the vent direction of the exhaust gases varies from one perforation to the next;

a plurality of perforated baffles spaced along the exterior surface of the barrel, each one of the plurality of perforated baffles extending from the exterior surface of the barrel to the interior surface of the housing and being sized to fit to the tapered shape of the housing; and a plurality of receiving grooves spaced along the interior surface of the housing to receive the baffles, whereby the tapered shape of the housing provides space for gas expansion and thereby enhances the suppression of noise from expanding gases.

2. The firearms noise suppressor of claim 1, further comprising a valve-operated fluid discharge port to discharge fluid after submersion of the suppressor in a fluid.

3. The firearms noise suppressor of claim 1, wherein the plurality of barrel perforations comprise a series of vents wherein each vent of the series of vents is oriented to vent in a different direction from a proximate vent.

4. The firearms noise suppressor of claim 1, further comprising a pair of joined housing moieties.

5. The firearms noise suppressor of claim 4, further comprising a gasket between the joined housing moieties.

6. A firearms noise suppressor for firearms that have a barrel with a distal end wherein the noise suppressor is attachable to the distal end of the barrel, the noise suppressor comprising:

a housing having an exterior surface and an interior surface, an interior chamber defined by the interior surface of the housing, a proximate end that is attachable to the distal end of a firearm barrel, and a distal end, the housing being tapered at each of the distal and proximate ends;

a barrel disposed within the interior chamber and having an exterior surface, and further having a length extending from the proximate end to the distal end of the housing, the barrel further having a plurality of perforations spaced apart along the length to vent exhaust gases, the perforations being oriented so that the vent direction of the exhaust gases varies from one perforation to the next;

a plurality of perforated baffles spaced along the exterior surface of the barrel, each one of the plurality of perforated baffles extending from the exterior surface of the barrel to the interior surface of the housing and being sized to fit to the tapered shape of the housing;

a plurality of receiving grooves spaced along the interior surface of the housing to receive the baffles; and a valve-operated fluid discharge port to discharge fluid after submersion of the suppressor in a fluid, whereby the tapered shape of the housing provides space for gas expansion and thereby enhances the suppression of noise from expanding gases.

* * * * *